US006755360B1

(12) United States Patent
Anderson et al.

(10) Patent No.: US 6,755,360 B1
(45) Date of Patent: Jun. 29, 2004

(54) FUEL INJECTOR WITH AN IMPROVED POPPET WHICH IS INCREASINGLY COMFORMABLE TO A VALVE SEAT IN RESPONSE TO USE

(75) Inventors: Kevin R. Anderson, Fond du Lac, WI (US); Christopher J. Misorski, Fond du Lac, WI (US)

(73) Assignee: Brunswick Corporation, Fond du Lac, WI (US)

( * ) Notice: Subject to any disclaimer, the term of this patent is extended or adjusted under 35 U.S.C. 154(b) by 386 days.

(21) Appl. No.: 09/797,143

(22) Filed: Mar. 1, 2001

(51) Int. Cl.[7] ..... F02M 51/00; B05B 1/30

(52) U.S. Cl. ..... 239/585.1; 239/533.7; 239/585.2; 239/585.3; 239/585.4; 239/585.5; 239/DIG. 19

(58) Field of Search ..... 239/533.7, 585.1, 239/585.2, 585.3, 585.4, 585.5, DIG. 19

(56) References Cited

U.S. PATENT DOCUMENTS

| | | | | |
|---|---|---|---|---|
| 2,523,917 A | * | 9/1950 | Payson | 148/326 |
| 2,734,008 A | * | 2/1956 | Kirkpatrick et al. | 148/530 |
| 3,165,401 A | * | 1/1965 | Reusch | 148/325 |
| 3,319,321 A | * | 5/1967 | Danis | 123/188.2 |
| 3,770,426 A | * | 11/1973 | Kloske et al. | 148/326 |
| 4,801,095 A | | 1/1989 | Banzhaf et al. | |
| 4,817,873 A | | 4/1989 | McKay | |
| 5,090,625 A | | 2/1992 | Davis | |
| 5,119,792 A | | 6/1992 | Gu | |
| 5,257,453 A | * | 11/1993 | Neumann et al. | |
| 5,407,131 A | | 4/1995 | Maley et al. | |
| 5,425,821 A | * | 6/1995 | Kurup et al. | |
| 5,479,901 A | * | 1/1996 | Gibson et al. | |
| 5,685,492 A | | 11/1997 | Davis et al. | |
| 5,947,380 A | | 9/1999 | Coldren et al. | |
| 6,047,671 A | | 4/2000 | Tubb et al. | |
| 2001/0035164 A1 | | 11/2001 | Hebbes et al. | |

FOREIGN PATENT DOCUMENTS

| | | |
|---|---|---|
| EP | 0556976 | 8/1993 |

* cited by examiner

*Primary Examiner*—Robin O. Evans
(74) *Attorney, Agent, or Firm*—Andrus, Sceales, Starke & Sawall, LLP

(57) ABSTRACT

Poppets for fuel injectors are provided with an improved sealing surface by making the poppet from a softer material than is known in the prior art. Instead of providing a Rockwell C hardness value of 50 or greater, as is known to those skilled in the art of poppet manufacture, the improved poppet is made of a softer material that allows the valve head of the poppet to wear in such a way that its shape conforms more accurately with a valve seat of the nozzle of a fuel injector. This also provides the beneficial result of improved salt water corrosion resistance. By using a softer metal to make the poppet, the improved sealing characteristic improves fuel efficiency of the engine and reduces emissions of undesirable compounds.

6 Claims, 2 Drawing Sheets

FUEL INJECTOR WITH AN IMPROVED POPPET WHICH IS INCREASINGLY COMFORMABLE TO A VALVE SEAT IN RESPONSE TO USE

BACKGROUND OF THE INVENTION

1. Field of the Invention

The present invention is generally related to a fuel or air-fuel injector and, more particularly, to a fuel injector made with a poppet that is formed of a material that increasingly conforms in shape to an associated valve seat in response to continued wear of the poppet through repeated contact with the valve seat.

2. Description of the Prior Art

Many different types of fuel injectors are known to those skilled in the art. Certain types of fuel injectors operate at high fuel and air pressures in order to be able to inject a fuel/air mixture directly into a combustion chamber of an internal combustion engine. Other types of fuel injectors operate at lower pressures and inject a fuel mist into an air stream flowing to combustion chambers of an internal combustion engine.

U.S. Pat. No. 5,090,625, which issued to Davis on Feb. 25, 1992, describes nozzles for in-cylinder fuel injection systems. The nozzle has a body having a fuel passage terminating in a port that, in use, communicates the fuel passage with an engine combustion chamber. The port has an annular seat therein and a valve element also having an annular seat which cooperates with the seat in the port to control fuel flow therein. An annular flow directing surface extends downstream from each of the annular seats, and each flow directing surface is contoured to blend smoothly with its respective seat.

U.S. Pat. No. 5,685,492, which issued to Davis et al on Nov. 11, 1997, describes fuel injector nozzles. An engine fuel injector has a selectively openable nozzle through which a fuel is delivered to the combustion chamber of the engine. The nozzle comprises a port having an internal annular surface and a valve member having an external annular surface coaxial with respect to the internal annular surface. Sealing contact between the valve member and the port is provided therebetween along a circular seat line substantially coaxial to the respective annular surfaces. The annular surfaces are configured so that when the internal and external annular surfaces are in sealing contact along the circular seat line, the seat line is located adjacent the downstream end of the passage for delivery of fuel with respect to the direction of the flow of fuel through the passage. The maximum width of the passage between the annular surfaces is not substantially more than 30 microns.

U.S. Pat. No. 6,047,671, which issued to Tubb et al on Apr. 11, 2000, describes a fuel injector system for an internal combustion engine. More particularly, a method of lubricating and cleaning a fuel injector of a fuel injection system of an internal combustion engine during running of the engine includes delivery both a lubricant and a cleaning additive to the injector. The injector injects directly into the combustion chamber of the engine. The lubricant and cleaning additive are delivered to the fuel exit area of the injector.

U.S. Pat. No. 4,817,873, which issued to McKay on Apr. 4, 1989, describes nozzles for in-cylinder fuel injection systems. A fuel injection nozzle for use in direct injection of fuel to an internal combustion engine is described in which the injector nozzle comprises a body having a longitudinal fuel passage terminating in a port which in use communicates the fuel passage with the combustion chamber of the engine. A valve element to co-operate with a valve seat provided in the port to control fuel flow to the combustion chamber and a fuel spray directing surface in the port extending downstream from the valve seat are described. The body includes a cavity between the spray directing surface and that part of the body through which the fuel passage passes, with the cavity being shaped and located to restrict the area for conductive heat flow from the spray directing surface to fuel passage area of the body. The restriction of the heat flow maintains the spray directing surface at a temperature to combust particles of combustion products deposited thereon.

U.S. Pat. No. 5,119,792, which issued to Gu on Jun. 9, 1992, describes an electromagnetic fuel injector with central air blow and poppet valve. The fuel injection mechanism for a two-stroke engine has two valve assemblies controlled by two solenoid assemblies. One solenoid assembly is provided for controlling the quantity of fuel to be injected into the fuel chamber and the other solenoid assembly includes a main solenoid for controlling the opening of a main fuel injection valve at an appropriate time, whereby fuel pre-stored in the fuel chamber is atomized and injected by a flow of high pressure air. The main fuel injection valve is formed in mushroom shape, wherein its middle portion is hollow and provides a passage for compressed air. The flow of compressed air, in two streams, is used for the solenoid head injection to improve an injection spray effect, to shorten the time of cleaning the fuel injector and to simplify the structure.

U.S. Pat. No. 5,407,13 1, which issued to Maley et al on Apr. 18, 1995, describes a fuel injection control valve. The control valve assembly for a fuel injector includes a valve seat with fluid inlet and fluid outlet and a flat seating surface. A poppet valve has a concave end portion with a knife edge for sealingly engaging the flat seating surface on the valve seat. The poppet valve is operated to close by a solenoid coil and is opened and maintained open by a return spring or a permanent magnet. Faster valve closing and faster valve opening is obtained.

U.S. Pat. No. 5,947,380, which issued to Coldren et al on Sep. 7, 1999, describes a fuel injector utilizing flat-seat poppet valves. A fuel injector includes a center tube, a first valve separate from the center tube and surrounding a first end of the center tube and a second valve also separate from the center tube and surrounding a second end thereof. A solenoid is actuable to independently move the first and second valves and thereby control the application of fluid pressures to first and second ends of a check assembly, in turn to control injection of fuel into an associated engine cylinder.

The patents described above are hereby explicitly incorporated by reference in the description of the present invention.

Poppets made in accordance with techniques known to those skilled in the art exhibit certain disadvantages under certain conditions. For example, when operated in severely corrosive environment, such as sea water applications, even poppets that are made of stainless steel material can corrode. When combined with certain other stress increasing conditions, this corrosion can lead to failure of the structural integrity of the poppets. This failure can, in turn, lead to the separation of the valve head of the poppet from the stem portion of the poppet. When this occurs, the valve head can fall into the combustion chamber and result in severe damage to the engine. Another problem that occurs in conjunction with poppets made in accordance with the prior art is that the wear surfaces of the poppet can exhibit microscopic chipping and cracking. If this occurs, the chipped area can allow leakage of fuel around the valve head of the poppet. In order to improve the wear resistance characteristic of the poppet, techniques known to those skilled in the art typically attempt to provide a hard surface in order to resist wear. The attempts to achieve higher Rockwell C hardness values in order to withstand the rigorous contact experienced by valve heads of poppets often include the addition of carbon to the stainless alloy used to make the poppet. The carbon combines with other alloying elements present in the stainless steel and forms primary carbides in the material. While improving the hardness, strength, and wear resistance of the material, the presence of alloy carbon levels in the stainless steel and the resulting existence of primary carbides lead to lower salt water corrosion resistance and a certain degree of brittleness that can result in microscopic chipping and cracking at the wear surface. It would therefore be significantly beneficial if a poppet could be made in such a way that the poppet material exhibited a high degree of salt water corrosion resistance and, in addition, resisted chipping and cracking at the wear surface.

SUMMARY OF THE INVENTION

A fuel injector made in accordance with the preferred embodiment of the present invention comprises an actuator portion and a nozzle portion having a fluid conduit extending there through and a valve seat formed in association with the fluid conduit. In addition, the fuel injection made in accordance with the present invention comprises a poppet having a valve head shaped to be received by the valve seat in sealing relation, the poppet being moveable relative to the nozzle portion between a closed position in which the fluid conduit is blocked and an open position in which the fluid conduit is at least partially unblocked, with the valve head of the poppet having a Rockwell C hardness value of less than 50.

One embodiment of the present invention comprises a valve head which is made of a martensitic stainless steel having an alloy carbon level of less than 0.5% and, more particularly, a valve head that is made of a material which is, by weight, between 12.25% and 13.25% chromium, between 7.5% and 8.5% nickel, between 0.9% and 1.35% aluminum, less than or equal to 0.5% carbon, and between 2.0% and 2.5% molybdenum.

A valve head made in accordance with the present invention is made of a material which is generally free of primary carbides. One embodiment of the present invention comprises a valve head which is made of a material which is precipitation hardenable stainless steel. The valve head of the present invention is conformable by wear with the valve seat in order to result in a generally smooth and chip free surface of the valve head in response to repeated contacts between the valve head and the valve seat.

A particularly preferred embodiment of the present invention is made of a material selected from the group consisting of martensitic stainless steel having an alloy carbon level less than 0.5% and precipitation hardenable stainless steel. The actuator can be a solenoid which is electrically actuable. Alternative embodiments of the present invention can incorporate a hydraulic actuator. The poppet is axially moveable within the fluid conduit in response to the actuator portion of the fuel injector, in a preferred embodiment of the present invention. After repeated contacts between the valve head and the valve seat, a valve head made in accordance with the softer material of the present invention has a significantly improved (i.e. smoother) surface finish in the region of contact with the valve seat.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
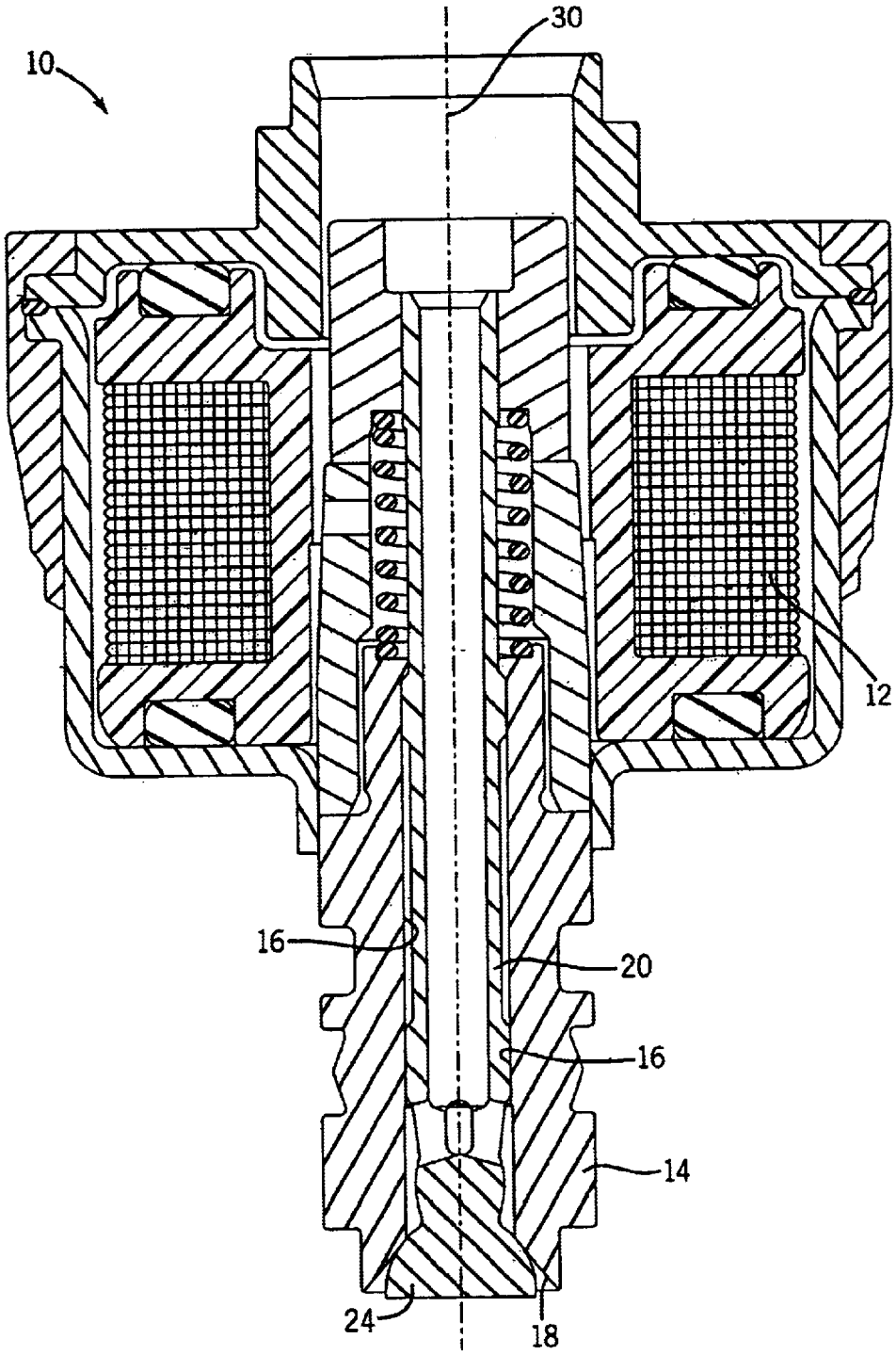
FIG. 1 is a section view of a fuel injector having a poppet made in accordance with the present invention.

Throughout the description of the preferred embodiment of the present invention, like components will be identified by like reference numerals.

FIG. 1 is a section view of a fuel injector 10 which comprises an actuator portion 12 which, in a preferred embodiment of the present invention, is a solenoid coil. The fuel injector 10 also comprises a nozzle portion 14 which comprises a cylindrical bore 16 and a valve seat 18 formed in association with the cylindrical bore 16. A poppet 20 has a valve head 24 shaped to be received by the valve seat 18 in sealing relation. The poppet 20 is moveable relative to the nozzle portion 14 between a closed position, as shown in FIG. 1, in which the cylindrical bore 16 is blocked at the valve seat 18 and an opened position in which the cylindrical bore 16 is at least partially unblocked at the valve seat 18. When the poppet 20 moves downward with respect to the nozzle 14, an annular opening is provided between the valve head and the valve seat 18. A liquid contained under pressure within the conduit 16 can escape through the annular opening when the poppet 20 is in the open position. Throughout the description of the present invention, the term "fuel injector" will be used to describe a device that is used to inject either liquid fuel or a fuel-air mixture either directly into a combustion chamber of an engine or into an air stream flowing toward a combustion chamber.

The type of fuel injector 10 shown in FIG. 1 is typically used in association with two-cycle engines. In this type of application, the poppet 20 opens and closes during each rotation of the crankshaft of the engine. In other words, when the engine is operated at 6000 RPM, the poppet 20 opens and closes 6000 times per minute. The contact between the valve head 24 of the poppet 20 and the valve seat 18 occurs at this same rate. As a result, the annular contact surface between the valve head 24 and the valve seat 18 can experience significant wear. Historically, in order to respond to this high exposure to potential wear, the poppets 20 are made of a hard material having a Rockwell C hardness in excess of 50. In order to achieve this degree of hardness, poppets known to those skilled in the art historically contain a substantial amount of carbide in an attempt to minimize wear by achieving a significantly high hardness value. Poppets made in accordance with the prior art are typically made from 440C stainless steel which is a martenistic stainless steel containing a substantial amount of primary carbide due, in part, to its very high carbon content of between 0.9% and 1.2%, by weight. This material is designated "S44004" under the Unified Numbering System (UNS).

In poppets made in accordance with techniques known to those skilled in the art, the high hardness values of the poppet 20 are expected to increase wear resistance and avoid leakage of fuel around the annular contact surface between the hemispherical surface of the valve head 24 and the mating surface of the valve seat 18. Leakage of fuel from the cylindrical bore 16 into the combustion chamber of an engine, by passing through the sealing contact region between the valve head 24 and the valve seat 18, can result in degraded engine operation, decreased fuel efficiency, and unacceptable environmental emissions as a result of excessive wear at the contact surfaces of the valve head 24 and valve seat 18. However, the use of poppets 20 having a valve head 24 with a Rockwell C hardness value in excess of 50 created several disadvantages.

Perhaps the most severe disadvantage of using 440C stainless steel is that it exhibits relatively low corrosion resistance in certain environments, such as a salt atmosphere. This characteristic is particularly disadvantageous when used in fuel injectors of engines that are used in marine propulsion systems. When the marine propulsion systems are used offshore, in salt water environments, severe corrosion of the poppets 20 can occur. This salt water corrosion leads to, among other things, cracks and stress related failures of the stems of the poppets 20. The results of this type of corrosion and resulting failures can be catastrophic if the poppet 20 physically separates from the fuel injector and falls into the combustion chamber of the engine.

Not only does 440C stainless steel exhibit relatively low corrosion resistance in a salt water atmosphere, but its hardware also does not achieve the desired purpose of wear resistance described above. The intent of making poppets from 440C stainless steel is to reduce wear and, as a result, minimize leakage at the annular contact surface between the valve head 24 and the valve seat 18. The increased hardness is actually counterproductive. In actuality, the high hardness value of the poppet material in the prior art actually results in microscopic cracking and chipping in the surface of the valve head 24 at the annular wear surface. This microscopic cracking and chipping creates a multitude of tiny leak paths between the valve head 24 and the valve seat 18 which, in poppets made of 440C stainless steel, actually allow fluid to leak past a closed poppet 20. Therefore, poppets made of 440C stainless steel not only exhibit lower corrosion resistance in salt water atmospheres but, in addition, do not actually provide reduced leakage around the valve head 24 as was expected by a poppet 20 with a surface exhibiting a Rockwell C hardness in excess of 50.

With continued reference to FIG. 1, it can be seen that the poppet 20 is disposed within the cylindrical bore 16 and in coaxial relation with the cylindrical bore 16 and axis 30. The precise manner in which fuel and air are conducted to the conduit 16 will not be described in detail herein, but the structure of fuel injectors 10 like that shown in FIG. 1 are described in significant detail in the patents identified above. The difference between the fuel injector 10 shown in FIG. 1 and fuel injectors made in accordance with the prior art is that the poppet 20, and particularly the valve head 24, is made of either a martensitic stainless steel having an alloy carbon level, by weight, of less than 0.5% or a precipitation hardenable stainless steel. In addition, the poppet 20 made in accordance with the present invention has a Rockwell C hardness value of less than 50.

Figure 2:
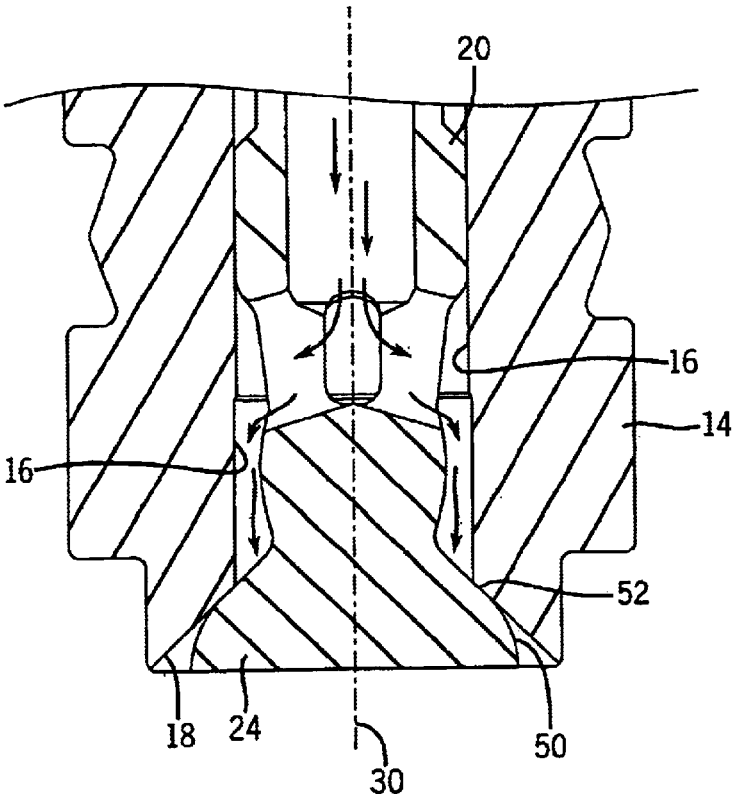
FIG. 2 is a section view of a nozzle of a fuel injector.

FIG. 2 illustrates the bottom portion of FIG. 1, showing the nozzle portion 14 with its cylindrical bore 16 formed through it and a valve seat 18 formed in association with the cylindrical bore 16 at the bottom portion of the nozzle portion 14. The poppet 20 moves upward and downward in FIG. 2, parallel to axis 30, to open and close an annular fluid passage located between the hemispherical surface 50 of the valve head 24 and the generally conical surface of the valve seat 18. The annular contact surface, in the region identified by reference numeral 52, is the location where the materials can exhibit wear. By using a material for the poppet 20 and particularly for the valve head 24, which is of a lower Rockwell C hardness value than 50, the valve head 24 is made in such a way that repeated contact with the valve seat 18 actually results in improved conformability of the valve head 24 with the surface of the valve seat 18. In other words, as the valve head 24 wears, it seats more effectively against the conical surface of the valve seat 18 and provides improved sealing compared to the sealing prior to actual use of the injector 10. In other words, by using a softer material for the poppet 20, wear of the valve head 24 actually beneficially changes the valve head 24 dimensionally to provide a higher degree of conformance between the surface of the valve head 24 and the mating surface of the valve seat 18. This results in a lowered leak rate than that which is achieved with a much harder poppet material. This lowered leak rate results in superior fuel efficiency of the engine and also decreases emissions that could result from leakage of fuel around the valve head 24 when the popper 20 is in an upward closed position.

As is well known to those skilled in the art, three basic types of stainless steel are widely used; austenitic, ferritic, and martensitic. The primary differences between the materials is their crystal structures. Austenitic stainless steel has a face centered cubic (FCC) crystal structure. Ferritic stainless steel has a body centered cubic (BCC) crystal structure. Martensitic stainless steel has a generally body centered tetragonal (BCT) crystal structure. When a martensitic stainless steel with a relatively high carbon content is cast, primary carbides can be formed in its structure. These carbides are an inter-metallic compound that contributes to a high Rockwell C hardness value and increased wear resistance from the presence of the inter-metallic compounds themselves. Typically, these primary carbides are of the general stoichiemetry $M_7C_3$ or $M_{23}C_6$ (where M is a metal of predominant carbide forming elements such as chromium, molybdenum, iron, etc.). These primary carbides form at elevated temperatures during solidification of the material. Secondary carbides that are of similar composition, but smaller in size, can form upon elevated heat treating or hardening operations. When certain martensitic stainless steels, such as 440C stainless steel, are used in applications such as poppets or fuel injectors, they are selected primarily for their hardness and wear resistance values with the intent of improving the wear characteristics of the poppet. However, higher hardness values in stainless steels generally coincide with lower salt corrosion resistance. Lower Rockwell C hardness values in stainless steels generally coincide with improved salt corrosion resistance. In the prior art, harder stainless steels are selected for poppet applications with the intent of reducing wear, over time, as the poppet continuously and repeatedly moves into and out of contact with its associated valve seat. However, as described above, stainless steels with Rockwell C hardness values in excess of 50 often exhibit minute cracking and chipping at the contact surface. Rather than reducing leakage around the valve head 24 of the poppet, this actually results in increased leakage between the mating surfaces of the valve head 24 and the valve seat 18, resulting in decreased fuel efficiency and increased emission of undesirable compounds.

The most immediately noticeable disadvantage of fuel injectors using poppets made of 440C stainless steel is that, in a salt water environment, corrosion of the poppet can lead to failure which can be exhibited by the disconnection of the valve head 24 from the stationary portions of the fuel injector. When this occurs, severe damage to the engine can be the result. In a preferred embodiment of the present invention, the poppet is made in one of two preferred types of material. The first type is a martensitic stainless steel having an alloy carbon level below 0.5% that is generally free of primary carbides. The second type of material which can be used in a preferred embodiment of the present invention is a precipitation hardenable stainless steel. In some cases, the material used in conjunction with the present invention for the poppet can be both types of materials simultaneously. For example, 13-8 Mo stainless steel is particularly suitable for use in poppets made in accordance with the present invention. The material is subsequently tempered to a hardness below the maximum possible achievable hardness for the alloy. Whereas poppets known in the prior art typically have Rockwell C hardness values in excess of 50, poppets made in accordance with the present invention have Rockwell C hardness values lower than 50. One material that is particularly preferred is 13-8 Mo stainless steel (UNS designation S13800) which is austenitized, quenched, and subsequently tempered at 1000 degrees Fahrenheit or 20 greater. Poppets made in accordance with the prior art include poppets made of 440C stainless steel (UNS designation S44004) and poppets made of 440 FSe stainless steel (UNS designation S44023).

Poppets made in accordance with the present invention actually improve the sealing capacity of the poppet 20 at the mating surface between the hemispherical 25 surface of the valve head 24 and the surface of the valve seat 18 in response to wear. As the softer material wears, from the repeated contacts between the valve head 24 and the valve seat 18, a glassy smooth surface of the valve head 24 is created with virtually no chipping or cracking, as is experienced when 440C stainless steel is used.

As described above, a preferred material within the scope of the present invention is 13-8 Mo stainless steel which comprises between 12.25% and 13.25% chromium, between 7.5% and 8.5% nickel, between 0.9% and 1.35% aluminum, between 2.0% and 2.5% molybdenum, and less than 0.05% carbon. In comparison, the 440C stainless steel known in the prior art for use in making poppets comprises 16.0% to 18.0% chromium, 0.75% maximum molybdenum, and between 0.95% and 1.2% carbon. This amount of carbon in 440C stainless steel provides a Rockwell C hardness value of 50 or greater, but also results in primary carbides formed during casting. These primary carbides can result in microscopic chipping and cracking in response to wear of the surface.

In FIG. 2, the arrows indicate the flow path taken by the fuel and air mixture as it passes through the fuel injector. As can be seen, the fluid mixture flows downward through the central cavity formed in the poppet and then radially outward through holes formed in the poppet. As the poppet 20 begins to move downward relative to the nozzle 14, the fuel and air mixture flows around the valve head 24 and through an annular gap formed between the valve head 24 and the valve seat 18 in the region of the annular sealing surface 52.

Figure 3:
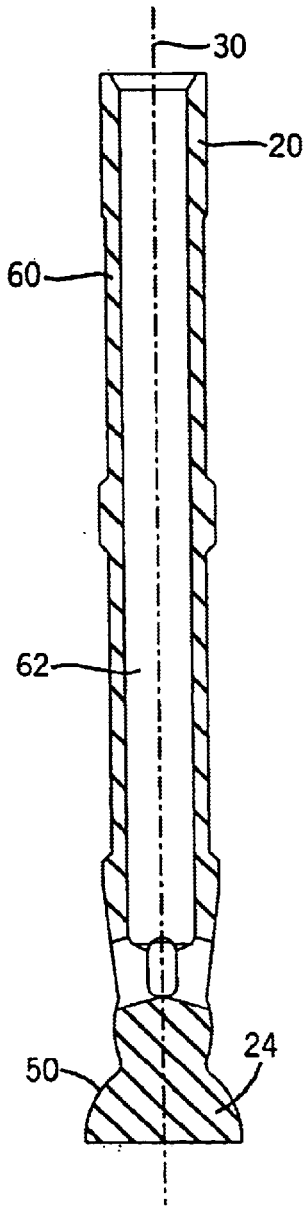
FIG. 3 is a section view of a poppet used in conjunction with a fuel injector.

FIG. 3 shows the poppet 20 of a fuel injector made in accordance with the present invention. For purposes of reference, centerline 30 is shown in FIG. 3 to allow the poppet 20 in FIG. 3 to be compared with the poppet 20 in FIG. 1 in relation to the nozzle portion 14 and the other stationary portions of the fuel injector 10. It can be seen in FIG. 3 that the poppet 20 is provided with a hollow stem 60. The hollow stem has a cavity 62 formed throughout a portion of its length. The valve head 24 is located at one end of the poppet 20 and is provided with a generally hemispherical surface 50 that is intended to move into and out of contact with the conical valve seat 18 described above in conjunction with FIGS. 1 and 2. Since a poppet 20 made in accordance with the present invention is made of a softer material than those materials used by those skilled in the art of poppet manufacture, the hemispherical surface 50 of the valve head 24 actually exhibits a controlled wear that results in improved conformation of the valve head 24 in association with the mating surface of the valve seal 18. In other words, a poppet made in accordance with the present invention actually improves the sealing capability of the valve head 24 when it wears. Any discontinuities that exist between the hemispherical surface 50 of the valve head 24 and the associated surface of the valve seat 18 are decreased when the valve head 24 wears. This results from the softer material used in conjunction with the present invention.

Table I compares the elements of two stainless steels known in the prior art for use in making poppets with the preferred alloy (i.e. 13-8 Mo) used in conjunction with the present invention.

TABLE I

| Element | 440C | 440FSe | 13-8 Mo |
|---|---|---|---|
| C | 1.0% Max | 0.95% to 1.2% | 0.05% Max |
| Mn | 1.25% Max | 1.25% Max | 0.10% Max |
| P | 0.04% Max | 0.04% Max | 0.01% Max |
| S | 0.03% Max | 0.03% Max | 0.008% Max |
| Si | 1.0% Max | 1.0% Max | 0.1% Max |
| Cr | 16.0% to 18.0% | 16.0% to 18.0% | 12.5% to 13.25% |
| Mo | 0.75% Max | 0.69% Max | 2.0% to 2.5% |
| Ni | — | 0.75% Max | 7.5% to 8.5% |
| Al | — | — | 0.9% to 1.35% |
| N | — | — | 0.01% Max |
| Se | — | 0.15% Min | — |

With reference to Table I shown above, it can be seen that the stainless steel (i.e. 13-8 Mo) used in conjunction with the present invention poppet contains less than 0.05% carbon. Although alternative embodiments of the present invention can contain up to 0.5% carbon, as an alloy carbon level, the 13-8 Mo stainless steel is the most preferred type of stainless steel to be used in conjunction with the present invention. In other words, trace or residual carbon, which is generally equivalent to 0.0% alloy carbon, is the most preferred. Although it is recognized that certain small amounts of trace or residual carbon can exist within the stainless steel, as incorporated with the iron, a preferred embodiment of the present invention comprises no alloy carbon level. As a result, the softer poppet material allows the valve head 24 to conform more precisely to the shape of the valve seat 18 as the valve head 24 wears as a result of repeated of moving into and out of contact with the valve seat 18. This softer material, which has a Rockwell C hardness value of 50 or less, creates a glassy smooth surface at the wear surface of the valve head 24 which provides improved sealing and avoids the minute cracking and chipping that normally occurs when harder stainless steels are used in the manufacture of poppets.

The conformability of the valve head 24 that is achieved by the softer material of the present invention provides significant benefits in the operation of an internal combustion engine. The improved sealing fit between the valve head 24 and the valve seat 18, after continued operation of the engine, can be seen in Table II, below.

TABLE II

| INJECTOR NUMBER | INITIAL LEAK RATE | SUBSEQUENT LEAK RATE |
|---|---|---|
| 1 | 8.46 ml/minute | 0.01 ml/minute |
| 2 | 12.06 ml/minute | 0.10 ml/minute |
| 3 | 0.34 ml/minute | 0.10 ml/minute |
| 4 | 6.32 ml/minute | 0.03 ml/minute |
| 5 | 4.27 ml/minute | 0.05 ml/minute |
| 6 | 9.02 ml/minute | 0.30 ml/minute |

Six injectors were analyzed, as shown above, both previous to operation of the engine and after 312 hours of engine operation. The results are shown in Table II above. Each injector was examined prior to use and subjected to operating pressures with the valve head 24 closed to prevent leakage between the valve head 24 and the valve seat 18. For example, injector number 1 exhibited a leak rate of 8.46 ml/minute prior to being used in an engine. Similarly, injector number 6 exhibited a leak rate of 9.02 ml/minute .

After being installed in an engine and run for 312 hours of engine running time, the leak rates of all six injectors decreased substantially. For example, injectors number 1 and number 6 exhibited leak rates of 0.01 ml/minute and 0.30 ml/minute, respectively. As shown in Table II, each of the six injectors show a remarkable decrease in leakage between the valve head 24 and valve seat 18 after operation of 312 hours in an engine. This improvement is a direct result of the better sealing relationship between the valve head 24 and the valve seat 18, at the annular sealing surface, as a result of the softer material used for the poppet. The softer material allows the surface of the valve head 24 to change shape slightly in order to conform to the valve seat 18. Rather than chipping and cracking, as in the poppet heads made in accordance with the prior art, the softer material of the present invention results in a smoother conformable surface that reduces leakage. The reduced leakage, in turn, improves both gasoline consumption and emissions. Less gasoline is wasted and included within the exhaust, as unburned hydrocarbons.

The annular sealing surface 52 has been examined both before and after operation for an extended period of time. Prior to use, the surface had an average surface finish $R_A$ of approximately 7.11 microinches and a peak surface finish $R_P$ of 13.80 microinches. After usage, the same surface had an average surface finish $R_A$ of approximately 3.43 microinches and a peak surface finish $R_P$ of 0.78 microinches. This empirical information was obtained with respect to injector number 6 in Table II.

The smoothing of the surface of the poppet, as a result of the softer material and through actual operation, is extremely significant. Furthermore, this smoothing significantly improves the sealing capacity of the poppet surface, particularly at the annular sealing surface at the contact region 52. This smoother surface, that occurs through actual usage, results in the decreased fuel usage and improved emissions described above.

Although the present invention has been described with considerable specificity and in conjunction with certain particular alloys, it should be understood that other alloys are also within its scope.

We claim:

1. A fuel injector, comprising:

an actuator portion;

a nozzle portion having a fluid conduit extending therethrough and a valve seat formed in association with said fluid conduit;

a poppet having a valve head shaped to be received by said valve seat in sealing relation, said poppet being movable relative to said nozzle portion between a closed position in which said fluid conduit is blocked and an open position in which said fluid conduit is at least partially unblocked, said valve head being made increasingly conformable to said valve seat by wear of said valve head through repeated contacts with said valve seat, said repeated contacts causing a contact surface of said valve head to achieve an increasingly smoother surface finish as a result of said wear.

2. The fuel injector of claim 1, wherein:

said valve head is made of a martensitic stainless steel having an alloy carbon level of 0.5% or less.

3. The fuel injector of claim 2, wherein:

said valve head is made of a material which is, by weight, 12.25% to 13.25% chromium, 7.5% to 8.5% nickel, 0.9% to 1.35% aluminum, less than or equal to 0.5% carbon, and 2.0% to 2.5% molybdenum.

4. The fuel injector of claim 1, wherein:

said valve head is made of a material which is generally free of primary carbides.

5. The fuel injector of claim 1, wherein:

said valve head is made of a material which is a precipitation hardenable stainless steel.

6. The fuel injector of claim 1, wherein:

said poppet is axially movable within said fluid conduit in response to said actuator portion.

* * * * *